US005307089A

United States Patent [19]

Takasu et al.

[11] Patent Number: 5,307,089

[45] Date of Patent: Apr. 26, 1994

[54] OPTICAL PRINTING HEAD

[75] Inventors: Hiromi Takasu; Masaharu Inaba, both of Tottori, Japan

[73] Assignee: Sanyo Electric Co., Ltd., Osaka, Japan

[21] Appl. No.: 560,596

[22] Filed: Jul. 31, 1990

[30] Foreign Application Priority Data

Aug. 7, 1989 [JP] Japan ..... 1-204471
Mar. 12, 1990 [JP] Japan ..... 2-60410

[51] Int. Cl.[5] ..... B41J 2/45

[52] U.S. Cl. ..... 346/107 R; 346/160

[58] Field of Search ..... 346/107 R, 160, 160.1, 346/76 PH; 358/300; 361/398, 400, 410, 412, 414, 416

[56] References Cited

U.S. PATENT DOCUMENTS 3,850,517 11/1974 Stephany et al. .
4,389,935 6/1983 Arai ..... 346/76 PH X
4,524,372 6/1985 De Cock et al. ..... 346/160
4,527,030 7/1985 Oelsch ..... 200/306
4,626,871 12/1986 Schuessler ..... 346/76 PH
4,689,694 8/1987 Yoshida ..... 346/107 R X
4,779,108 10/1988 Inoue ..... 346/160
4,807,047 2/1989 Sato et al. ..... 358/300
4,829,404 5/1989 Jensen ..... 361/416 X
4,896,168 1/1990 Newman et al. ..... 346/107 R
4,899,174 2/1990 Newman et al. ..... 346/107 R

FOREIGN PATENT DOCUMENTS 0084684 6/1980 Japan ..... 346/76 PH
63-254068 10/1988 Japan .

*Primary Examiner*—Benjamin R. Fuller
*Assistant Examiner*—David Yockey
*Attorney, Agent, or Firm*—Darby & Darby

[57] ABSTRACT

A dynamic driving type optical printing head comprising a plurality of LED elements divided into a plurality of groups, wherein the LED elements are driven in time-division by groups, comprises a plurality of LED blocks arranged along the scanning direction on the head substrate, wherein each of the LED blocks comprises a plurality of LED elements arranged in the scanning direction; a plurality of wiring blocks arranged along the array of the LED blocks, wherein each of the wiring blocks comprises a plurality of selecting signal lines; and one or more data drivers; wherein each of the LED elements is connected to the corresponding selecting signal line in the wiring block by wiring means, and the selecting signal line is connected to the data driver by wiring means, so that the plurality of LED elements in each of the LED groups are connected to the data driver individually to each other.

9 Claims, 6 Drawing Sheets

OPTICAL PRINTING HEAD

BACKGROUND OF THE INVENTION

1. Field of the Invention

The present invention relates generally to optical printing heads comprising a plurality of light emitting diodes (LED), and more particularly, to the improvement of the so-called dynamic driving type optical printing head.

2. Description of the Related Art

An example of a printing system including an optical printing head having a LED array is described in U.S. Pat. No. 3,850,517, for example.

In general, an optical printing head having a LED array comprises a plurality of LED blocks arranged along the main scanning direction of the optical printer. Each of the LED blocks comprises a plurality of LED elements having an one-to-one correspondence with the printing dots of the main scanning direction. It is therefore possible to control the selected desired LED elements to be energized simultaneously in the main scanning direction. For the purpose of realizing this advantage, a static driving type optical printing head comprising a driver having the number of bits identical to the number of the LED elements is used in practice.

An optical printing head utilizing LED array also has other advantages. These advantages include the precise control of the printing dot shape and dot location, as well as the dispensability of mechanical scanning means in the main scanning direction. Consequently, not only a printing optical head of the static driving type, but also an optical printing head of the dynamic driving type energizing LED elements in time-division has been developed. An example of a dynamic driving type optical printing head is disclosed in Japanese Patent Laying-Open No. 63-254068, for example.

FIG. 1A is a schematic top view showing the dynamic driving type optical printing head disclosed in Japanese Patent Laying-Open No. 63-254068, whereas FIG. 1B is a sectional view taken along line 1B—1B of FIG. 1A. A dynamic driving type optical printing head requires many conductor lines to be formed in high density on a head substrate 1. Particularly, selecting signal lines 41, 43 are formed in a matrix manner for selectively energizing the desired elements of the many LED elements 22.

In general, LED elements 22 are grouped by LED blocks 2 and dynamically driven in time-division. A common electrode 13 is formed on head substrate 1 for each LED block 2, whereby the bottom of each LED block 2 is joined to the corresponding common electrode 13 with conductive adhesive.

Within one LED block 2, the selected desired LED elements 22 are energized simultaneously. In the case where one LED block 2 comprises 64 LED elements 22 for example, 64 selecting signal lines are necessary to connect the LED elements 22 individually to a data driver 3. In FIG. 1A, the selecting signal lines comprise 64 bridging lines 41 provided in parallel with the array of the LED elements, and selecting lead lines 43 connecting each of the 64 LED elements 22 of LED block 2 to the corresponding bridging line 41.

Selecting lead lines 43 provided in groups of 64 lines per period for every LED block 2 are formed directly on head substrate 1 and arranged in parallel with each other in a pitch equal to the pitch of the LED element 22 array. Each of selecting lead lines 43 is covered by an interlayer insulator film 42, except for the portion in the proximity of LED element 22. Bridging lines 41 are formed on interlayer insulator film 42, with one end of each selecting lead line 43 connected to the corresponding bridging line 41 via a contact hole 42H. The other end of each selecting lead line 43 is connected to the corresponding LED element electrode 23 by wire bonding. One end of each bridging line 41 is connected to data driver 3 by wire bonding. Accordingly, LED element 22 of each LED block 2 is individually connected to data driver 3 via the corresponding selecting lead line 43 and bridging line 41.

The printing head in accordance with the above described prior art may use a glass plate or a sintered ceramic plate for head substrate 1. In the case a glass head substrate 1 is used, selecting signal lines 41, 43 may be formed under thin film technology by sputtering or evaporation because the surface of the substrate is smooth. It is therefore possible to form bridging lines 41 in density to reduce the width of head substrate 1. However, a large vacuum apparatus is required for the purpose of sputtering or evaporation because the entire head substrate 1 has a large dimension. A large and precise apparatus is also required for precise patterning of the sputtered or evaporated thin film. There is also a disadvantage that the glass head substrate 1 is liable to cracking due to its long length, which will be aggravated if the width is further decreased.

In the case where head substrate 1 of sintered ceramic is used, the strength of head substrate 1 is high, but the smoothness of the substrate surface is low. Therefore, selecting signal lines 41, 43 are formed under thick film technology using silk-screen printing method. Consequently, the width of the bundle of bridging lines 41 will increase to expand the entire width of the printing head. It is preferred that the width of the printing head is small because not only the printing head, but also many other devices such as a charger, a toner supply device, a transfer device, a cleaner, etc. are arranged in the periphery of the optical printer's photoreceptor drum.

There is also a problem that the bundle of bridging lines 41 formed of very long fine lines (generally exceeding at least 200 mm) parallel to each other in high density is susceptible to shorts and disconnections. When such shorts and disconnections occur, partial repair is difficult, leading to the discard of the entire head substrate 1.

Furthermore, when the number of the LED blocks used is changed, a head substrate 1 having a bundle of bridging lines 41 formed with the corresponding change in length must be provided.

In addition, bonding operation by wiring means, such as wire bonding or TAB (tape-automated-bonding) between selecting lead line 43 and LED element electrode 23 is not easy due to the difference in their heights, as can be seen from FIG. 1B.

SUMMARY OF THE INVENTION

In view of the foregoing, an object of the present invention is to provide an optical printing head of small width by comprising a bundle of bridging lines formed in high density, and that is easy to handle.

Another object of the present invention is to provide an optical printing head that can have bridging lines in high density with high precision formed, without need of a large vacuum apparatus.

A further object of the present invention is to provide an optical printing head that is easy to repair even when shorts and disconnections occur in the selecting signal lines.

A still further object of the present invention is to provide an optical printing head that allows changing the number of LED blocks readily.

A still further object of the present invention is to provide an optical printing head that allows bonding operation by wiring means readily and securely.

In accordance with the present invention, a dynamic driving type optical printing head comprising a plurality of LED elements divided into a plurality of groups, wherein the LED elements are driven in time-division by groups, comprises a head substrate; a plurality of LED blocks arranged along a scanning direction on the head substrate, wherein each of the LED blocks includes a plurality of LED elements arranged in the scanning direction; a plurality of wiring blocks arranged along the LED block array, wherein each of the wiring blocks includes a plurality of selecting signal lines; and one or more data drivers; wherein each of the LED elements is connected to the corresponding selecting signal line of the wiring block by wiring means, and the selecting signal line is connected to the data driver by wire bonding, so that the plurality of LED elements in each of the LED groups are connected to the data driver individually to each other.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 2A:
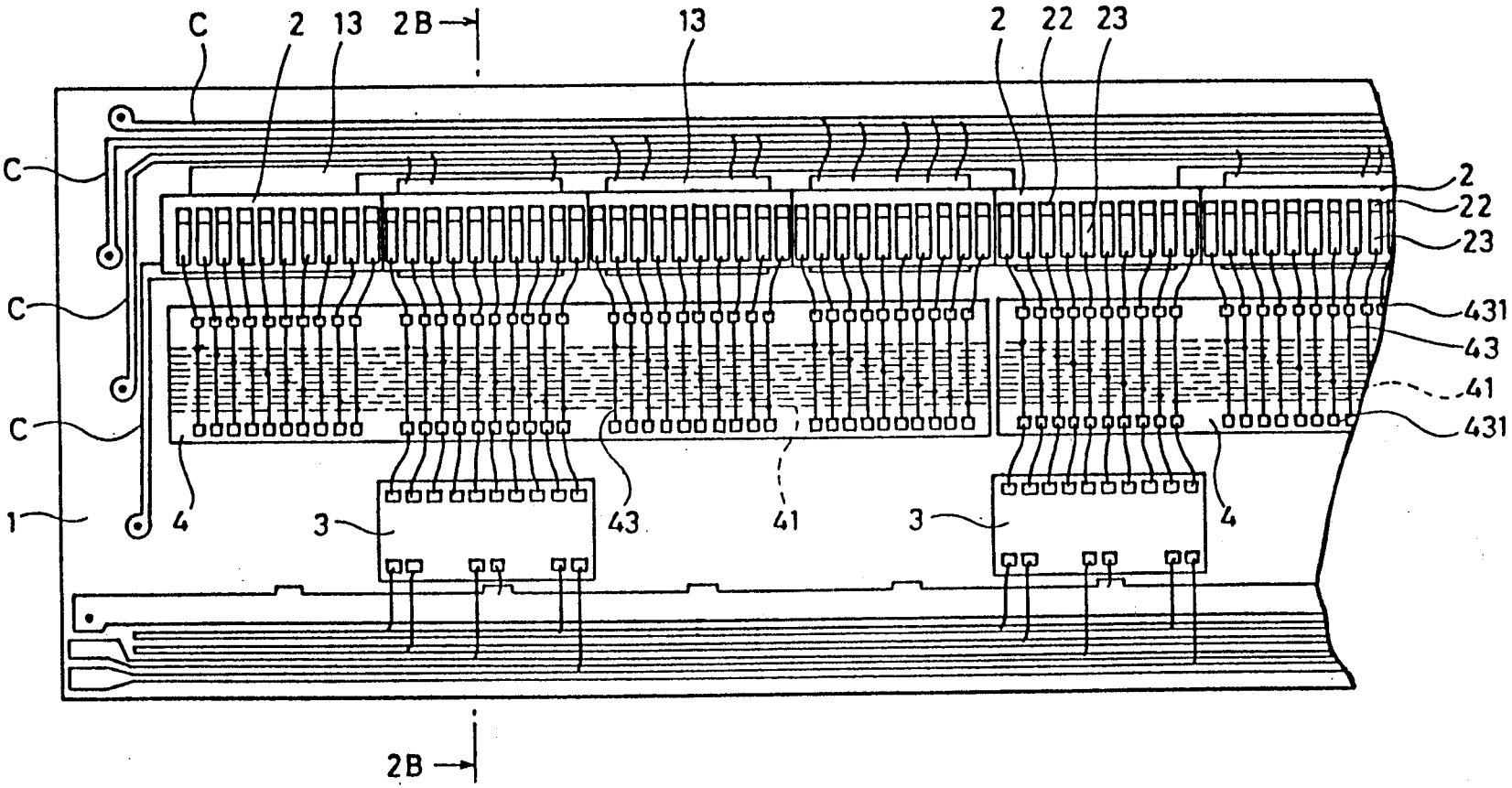
FIG. 2A is a top plan view of an optical printing head in accordance with one embodiment of the present invention.
Figure 4:
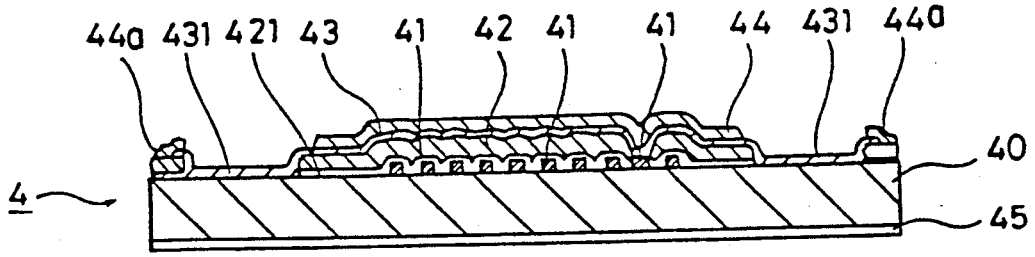
FIG. 4 is a sectional view showing the wiring block in detail.

Referring to FIGS. 2A and 4, an optical printing head in accordance with the first embodiment of the present invention is described. For the sake of clarity, LED blocks 2 each including only ten LED elements 22 are shown in FIG. 2A. In practice, each of LED blocks 2 includes more LED elements 22 in numbers such as 32 elements, 64 elements, or 128 elements, which are dynamically driven as the unit of LED block 2. It is to be noted that the values shown specifically in the description are associated with an optical printing head having 2048 dots (300 dpi: approximately 12 dots per 1 mm) and dynamically driven on a 64-bit unit basis.

Figure 2B:
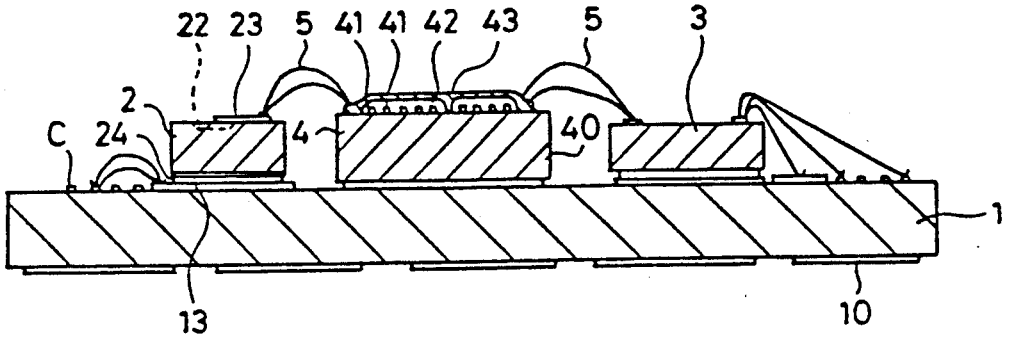
FIG. 2B is a sectional view taken along line 2B—2B of FIG. 2A.
Figure 3:
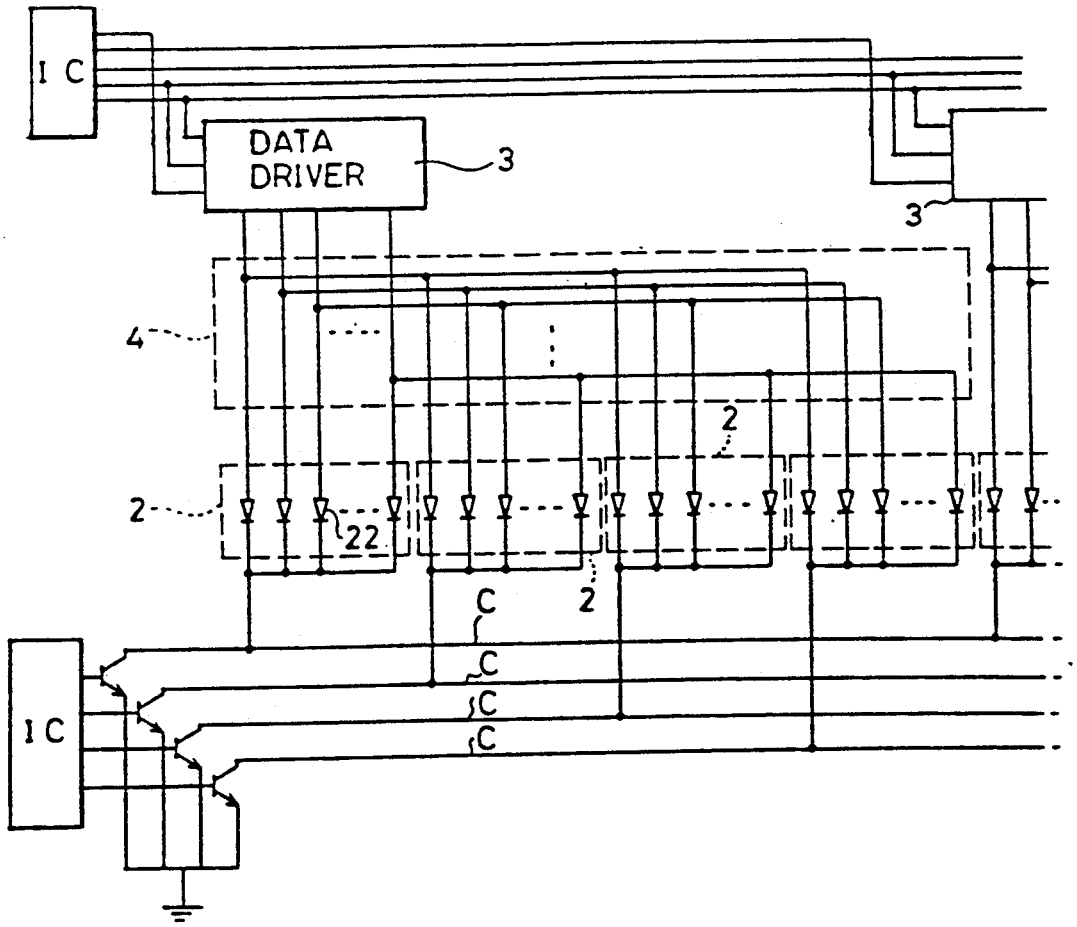
FIG. 3 is an equivalent circuit diagram of the optical printing head of FIG. 2A.

As the head substrate 1 also called "motherboard", a sintered ceramic plate having sufficient strength, a printed circuit board such as an epoxy impregnated paper plate or an epoxy impregnated glass fiber plate, or a metal plate having an insulator surface may be used. Referring to FIG. 2B, the pattern of a wide power supply line 10 is formed on the back side of head substrate 1. Power supply line 10 is connected to the conductor line formed on the upper surface of head substrate 1 via a throughhole.

On the upper surface of head substrate 1, 32 LED blocks 2 are arranged along the main scanning direction of the optical printer. Each of LED blocks 2 comprises 64 LED elements 22 arranged in one row on the upper surface along the main scanning direction. This results in 2048 LED elements 22 arranged in one row in the main scanning direction at the pitch of 83 μm. The LED elements 22 may be arranged in two rows in a zigzag manner along the main scanning direction.

As can be seen from FIG. 2B, LED block electrode 24 is formed on the bottom of LED block 2. LED block electrode 24 is joined to common electrode 13 by conductive adhesive. Common electrode 13 is connected to common line C either directly, or by wire bonding.

On the upper surface of head substrate 1, a plurality of data drivers 3 are mounted for selectively energizing LED elements 22. In FIG. 2A, one data driver 3 is provided for driving four LED blocks 2, with a total of 8 data drivers 3 mounted on head substrate 1. Each data driver 3 having a serial input and 64 bit parallel output comprises a shift register, a latch register, a driver array, etc.

Between LED block 2 and data driver 3, a wiring block 4 including selecting signal lines 41, 43 in a matrix manner are mounted on the upper face of head substrate 1. Wiring block 4 comprises a wiring substrate 40 having a length of the integral multiple of the length of LED block 2. In the example of FIG. 2A, one wiring block 4 has a length of four LED blocks 2. On wiring substrate 40, 64 bridging lines 41 are formed extending in parallel with the array of LED blocks 2. Bridging line 41 is covered by interlayer insulator film 42.

Figure 1A:
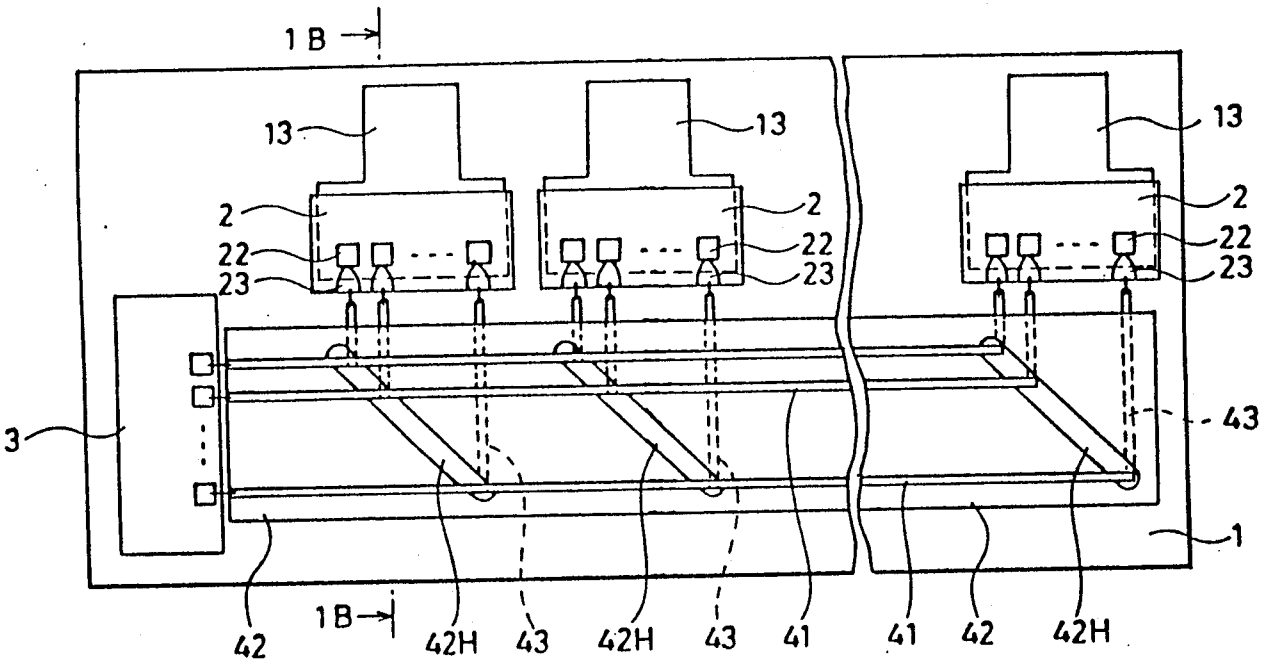
FIG. 1A PRIOR ART
FIG. 1A is a plan view of a dynamic driving type optical printing head of the prior art.
Figure 1B:
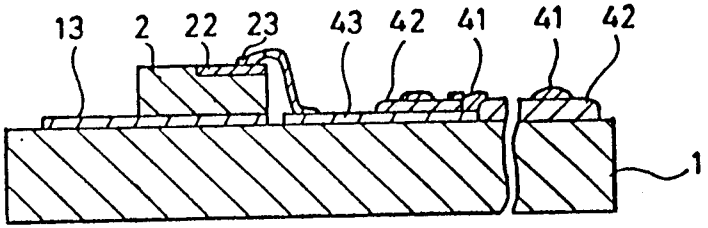
FIG. 1B PRIOR ART
FIG. 1B is a sectional view taken along line 1B—1B of FIG. 1A.

Over interlayer insulator film 42, a plurality of selecting lead lines 43 substantially orthogonal to bridging lines 41 are formed in parallel with each other. The plurality of selecting lead lines 43 are grouped by 64 lines, with the spacing of the selecting lead lines 43 in one group is set to be not more than the pitch of the LED elements 23 in the array. Each selecting lead line 43 is connected to the corresponding bridging line 41 via a contact hole formed in interlayer insulator film 42. In FIG. 2A, all selecting lead lines 43 cross the bundle of bridging lines 41, with bonding pads 431 at both ends. The selecting lead line 43 not connected directly to the bonding pads on the upper face of data driver 3 by wire bonding, but connected to data driver 3 via the corresponding bridging line 41 may terminate at the corresponding contact hole, as in FIG. 1A.

As in the case of FIG. 2A where all the selecting lead lines 43 have bonding pads 431 at both ends, it is possible to connect data driver 3 to an arbitrary group of selecting lead lines 43 which are grouped by every 64 lines in one wiring block 4. Each LED element electrode 23 is connected to the bonding pad 431 of the corresponding selecting lead line by wire bonding. It can be understood from FIG. 2B that by alternately varying the height of each arch formed by bonding wires disposed in close proximity to each other according to the number of LED elements 22, occurrence of short-circuit between adjacent bonding wires may be reduced.

Instead of bonding wires, lead lines supported on an insulator thin film may be used. A plurality of lead lines supported on the insulator layer can be connected to LED blocks and wiring blocks as a bundle by wiring means called TAB (tape-automated-bonding), as disclosed in U.S. Pat. No. 4,779,108, for example. Making the height of LED blocks and wiring blocks roughly equal will facilitate the connection operation and ensure the connection, also in the case where wiring means of TAB is used.

In the optical printing head of FIG. 2A, one LED block 2 of the LED blocks 2 grouped by 4 is selected in time-division by common line C, whereby the selected desired LED element 22 within the selected LED block 2 is energized by data driver 3 via selecting signal lines 41, 43 on wiring block 4.

Because selecting signal lines 41, 43 in high density must be formed on wiring substrate 40 in high precision, a glass plate or a semiconductor plate having a smooth surface is used as wiring substrate 40. A protective film may be provided on the surface of wiring substrate 40 if desired. It is preferred that wiring substrate 40 has a thickness of approximately 0.5 mm which is roughly equal to the thickness of LED block 2 and data driver 3. This is because wire bonding may be accomplished easily and securely if the height of the bonding pads on LED block 2, wiring block 4, and data driver 3 are equal. In the case wiring substrate 40 is a transparent glass, a black film 45 may be provided on the bottom of wiring substrate 40, as seen in FIG. 4, for the purpose of facilitating the recognition of the pattern of the formed selecting signal lines, as well as to prevent undesired reflection.

On the smooth upper surface of wiring substrate 40, long bridging lines 41 are formed, which must be disposed in parallel in high density. Bridging lines 41 are formed by depositing a conductor thin film by sputtering or by evaporation, followed by patterning the conductor thin film by photolithography. When wiring block 4 is long, the brightness of LED elements 22 located far from data driver 3 will decrease if the resistance per unit length of bridging line 41 is high. As a result, it is preferred that bridging line 41 has a resistance value of not more than approximately 5 Ω/cm. Therefore, 64 lines of aluminum conductor having a relatively high thickness of 3–5 μm and a width of 20–25 μm are formed in parallel at a pitch of 30–40 μm.

The bundle of bridging lines 41 formed as in the above manner is covered by an interlayer insulator film 42. It is preferred that interlayer insulator film 42 is formed to be relatively thick with a flat upper surface because selecting lead lines 43 are formed on interlayer insulator film 42. It is difficult to form a thick interlayer insulator film 42 by sputtering or the like, and cracks and pin holes are easily generated in the interlayer insulator film between the bridging lines 41. On the contrary, polymer material makes it easy to form a thick film and to flatten the surface of the film.

An organic polymer interlayer insulator film 42 comprising silicon with a practically flat upper face may be obtained by applying a solution including the mixture of organosilicon compound $R_nSi\ (OH)_x$, glass-forming agent, and organic binder dissolved into an alcohol solvent comprising ester and ketone on the bundle of bridging line 41 by a spinner and drying the same. Since the additives in the organic polymer interlayer insulator film 42 have deteriorative effect to the aluminum bridging lines, the bundle of bridging lines 41 should be covered by an inorganic thin film 421 in advance, as shown in FIG. 4.

A polyimide type material may be used for interlayer insulator film 42. For example, a solution with a viscosity of about 11 poise comprising P phenylene diamine, pyromellitic anhydride, diamine type carboxamide, and benzophenone tetracarboxylic anhydride is spinned on for 30 seconds at 2000–3000 rpm and prebaked for 60 minutes at 200° C. Next, a contact hole is formed by photo etching method, followed by baking at 350° C. to obtain interlayer insulator film 42. Such a polyimide type interlayer insulator film may be formed to a desired thickness of 1–4 μm without the generation of pin holes and without deteriorative effect to aluminum bridging lines 41. A polyimide type interlayer insulator film 42 is preferred because there is no unnecessary stress to the bundle of bridging lines 41, and because the space between bridging lines 41 is filled to flatten the upper surface. The formation of bridging lines 41 directly disposed on wiring substrate 40 as the first conductor layer in a density higher than selecting lead lines 43 is preferable also for the flattening of interlayer insulator film 42.

Selecting lines 43 on interlayer insulator film 42 can be formed by patterning the aluminum thin film. Each selecting lead line 43 has a width of 50 μm and a thickness of 1–2 μm, for example. The selecting lead lines 43 parallel to each other are grouped by 64 lines and arranged at a pitch of 83 μm or below which is the pitch of the array of LED elements 22 within one group. Over selecting lead lines 43, a protective insulator film 44 is formed.

On either side of each selecting lead line 43, a bonding pad 431 is provided. It can be seen from FIG. 4 that bonding pad 431 is formed directly on wiring substrate 40 so that it will not peel off by the shock at the time of wire bonding. The edges of the bonding pads are covered by a protective insulator film 44*a*.

The wiring block 4 that can be formed in the above described manner may be prepared in the maximum length allowed in manufacturing to be cut to an appropriate length in mounting on head substrate 1.

Because bridging lines 41 may be formed in high density on wiring substrate 40, the width of wiring block 4 is only 3 mm for 64 bits and only 4 mm for 128 bits. As a result, the width of the optical printing head may be narrowed as to 15–30 mm.

In addition, when one of the wiring blocks 4 on the optical printing head comprises shorts or disconnections that wiring block can be replaced by a new one.

Figure 5A:
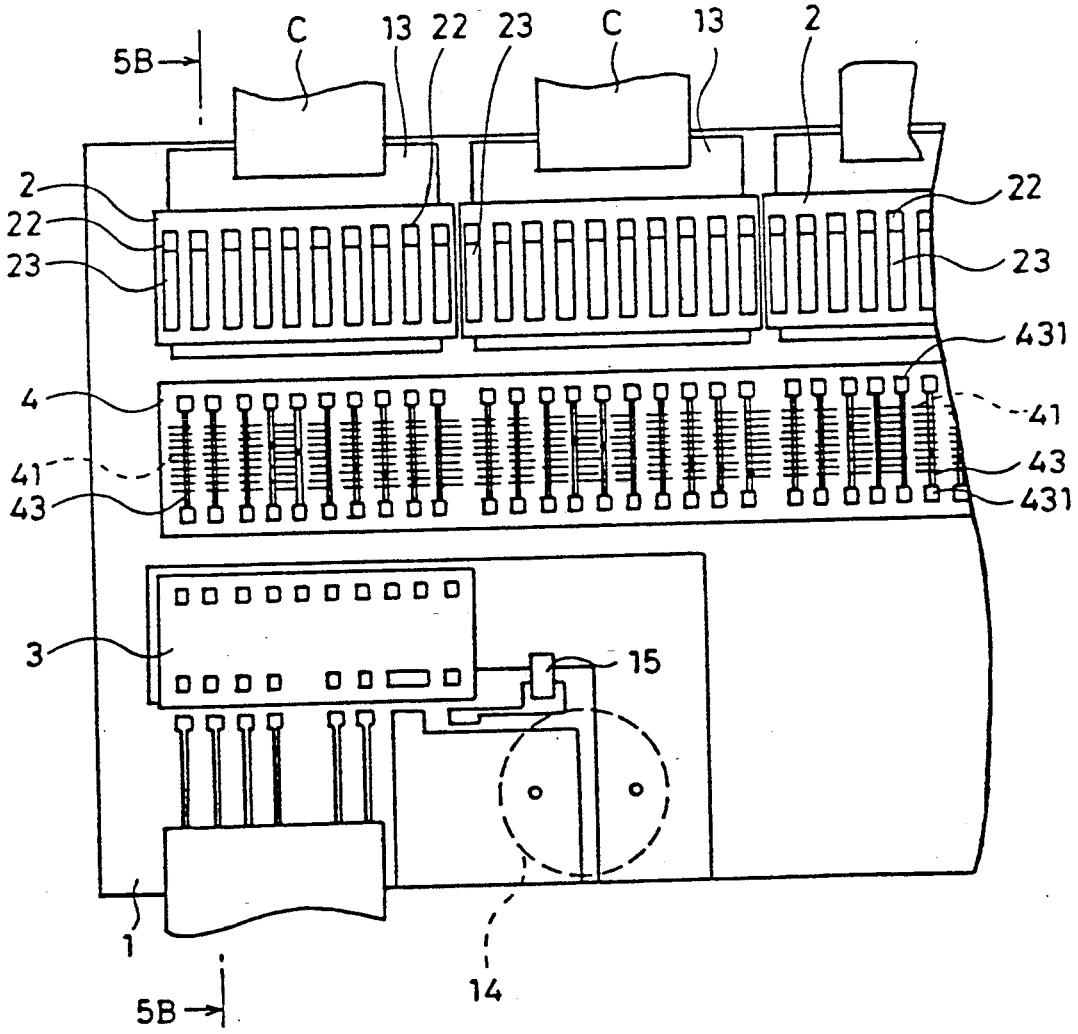
FIG. 5A is a top plan view of an optical printing head in accordance with a second embodiment of the present invention.
Figure 5B:
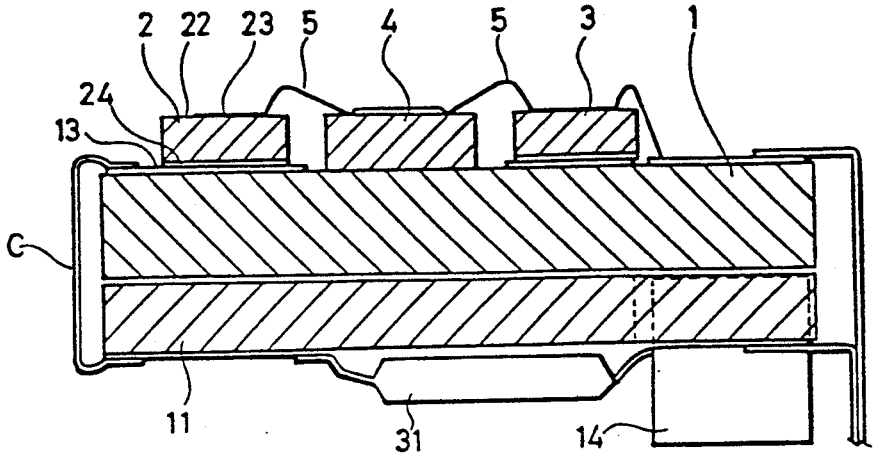
FIG. 5B is a sectional view taken along line 5B—5B of FIG. 5A.

Referring to FIGS. 5A, 5B, 6, and 7, a second embodiment of the present invention is described. The wiring block in the second embodiment is longer than that of the first embodiment. A capacitor 14 is preferably provided in the power supply circuit, as shown in FIGS. 5A and 5B, because pulse noise is easily generated in dynamic driving. A second head substrate 11 is provided on the back side of head substrate 1, to which a common driver 31 is provided beneath the second head substrate 11. This common driver 31 selects LED block 2 in time-division via common line C and common electrode 13.

Because data driver 3 energizes different number of LED elements at different times, a constant current output type, for example a MOS type current mirror circuit, is preferable to prevent variations in the brightness of those LED elements. In the case of constant current driving, it is preferred that a reference resistor 15 setting the constant current output is disposed in the proximity of data driver 3 because the driving pulse frequency of the power control is high. If reference resistor 15 is placed far from driver 13, there is a possibility of the output timing being delayed and the constant current effect being lost.

Figure 6:
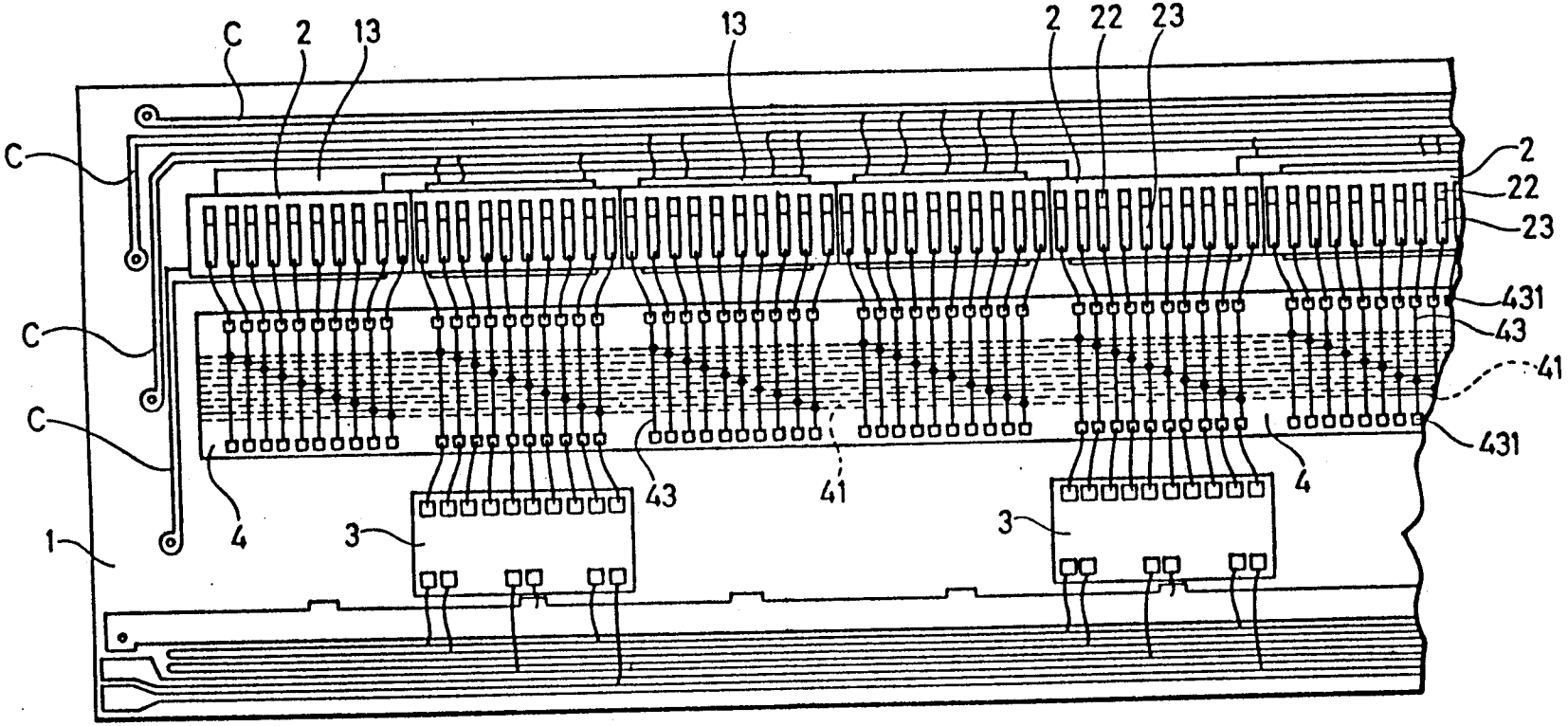
FIG. 6 is a schematic top plan view of an optical printing head having two or more data drivers provided for each of the wiring blocks.

In FIG. 5A, data driver 3 is disposed near one end of wiring block 4. However, it is desired that data driver 3 is disposed in the middle of the length of wiring block 4 when wiring block 4 is long, due to the fact that the resistance value of bridging line 41 can not be ignored. Furthermore, when wiring block 4 is much longer, decrease in the brightness of the LED elements may be prevented by providing two or more data drivers 3 in one wiring block, as shown in FIG. 6.

Common driver 31 is a power driver having a current absorbing type output, whereby a shift register or the like formed of bipolar transistors, BiMOSs or power MOSs, etc. may be used. In dynamic driving by 64 bits, common driver 31 may generate heat because a maximum of 64 LED elements may be energized at one time. It is therefore preferred that common driver 31 is provided beneath the second head substrate 11.

Figure 7:
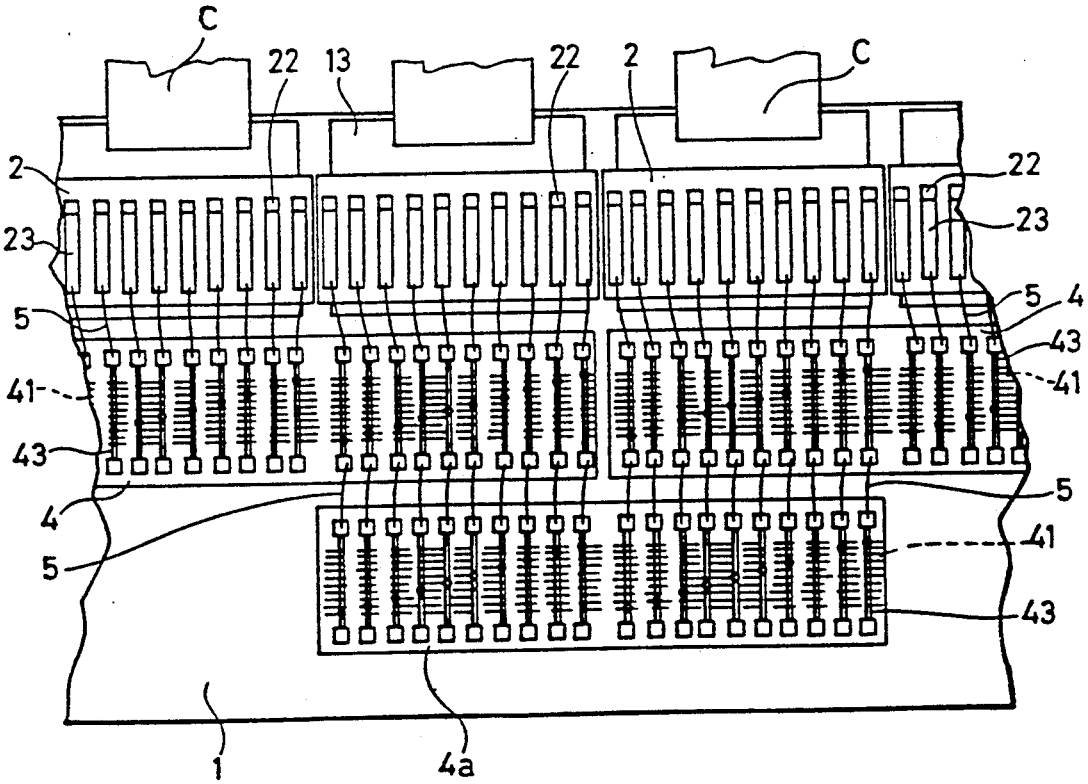
FIG. 7 is a top plan view showing the electrical connections of the bridging lines between two adjacent wiring blocks.

Referring to FIG. 7, a method is shown of electrically connecting the corresponding bridging lines 41 to each other of two wiring blocks. At the boundary portion of two wiring blocks 4 to be electrically connected to each other, a third wiring block 4*a* is disposed in parallel with the two wiring blocks 4. The third wiring block 4*a* has a length of two LED blocks 2. The selecting lead lines 43 in the two wiring blocks 4 to be connected to each other are connected to the corresponding selecting lead lines 43 of the third wiring block 4*a* by wire bonding. Accordingly, the corresponding bridging lines 41 in the two wiring blocks 4 to be connected to each other are mutually connected via the corresponding bridging line 41 in the third wiring block 4*a*. By utilizing the electrical connection between two wiring blocks, such as those shown in FIG. 7, a plurality of short wiring blocks may be connected to each other to be used likewise as one long wiring block.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An optical printing head comprising:

a head substrate, a plurality of elongated LED blocks each having a first side and second opposing side and being arranged end to end along a scanning direction on said head substrate, each of said LED blocks having a plurality of LED elements arranged thereon which are to be selectively energized along said scanning direction, a plurality of elongated wiring blocks on said substrate each having a first side and an opposing second side, said wiring blocks each having said first side adjacent said second side of at least two of said plurality of LED blocks, said, wiring blocks having a plurality of selecting signal lines, of a number at least equal to a number of said plurality of LED elements on each of said LED blocks to be selectively energized, formed thereon along the length of said wiring blocks and spanning the length of said plurality of LED blocks, a data driver means on said substrate adjacent said second side of said wiring blocks for selectively energizing each of said LED elements of each of said plurality of LED blocks, first wiring means for connecting a group of LED elements, formed by one of said LED elements of each of said plurality of LED blocks, to an identical selecting signal line on said wiring blocks, each of said LED elements of each of said plurality of LED blocks being part of a separate group connected to the one selecting signal line, and second writing means for connecting each of said selecting signal lines to said data driver means, said data driver means selectively causing the energization of the LED elements of each of said plurality of LED blocks through said second wiring means, a selecting signal line, and said first wiring means, wherein the LED elements are divided into a plurality of groups which are to be driven in time division, at least one of said groups including at least one of said LED elements of each of said LED blocks, said plurality of wiring blocks being arranged alongside and adjacent to, said plurality of LED blocks, at least one of said wiring blocks having a length at least equal to the length of two LED blocks and said plurality of selecting signal lines of said at least one of said wiring blocks including (i) a plurality of bridging lines formed in parallel with each other on said at least one of said wiring blocks and having a length of substantially two LED blocks, and (ii) a plurality of selecting lead lines crossing said bridging lines and connected to a corresponding bridging line; and said plurality of bridging lines being electrically connected in one-to-one correspondence between at least two of said wiring blocks.

2. The optical printing head according to claim 1, wherein said wiring blocks comprise a wiring substrate of a substance selected from the group consisting of glass and semiconductor materials.

3. The optical printing head according to claim 2, wherein said plurality of selecting signal lines of each of said wiring blocks is formed by patterning with photolithography of a conductive thin film on a surface thereof.

4. The optical printing head according to claim 1, further comprising an interlayer insulator film between said bridging lines and selecting lead lines.

5. The optical printing head according to claim 1, wherein there are more wiring blocks than said data driver means.

6. The optical printing head according to claim 1, wherein said plurality of selecting lead lines are substantially parallel to each other, grouped by a predetermined number, and disposed at a pitch that is not wider than the pitch of said LED elements within one of said groups.

7. The optical printing head of claim 4 wherein the material of said insulation film is organic.

8. An optical printing head comprising:

a head substrate, an elongated LED block having opposed first and second sides arranged along a scanning direction on said head substrate, said LED block having a plurality of LED elements thereon to be selectively energized and which are arranged in said scanning direction, an elongated wiring block having opposed first and second sides on said substrate and having said first side thereof adjacent said second side of said LED block, said wiring block having a plurality of selecting signal lines formed thereon, data driver means on said substrate adjacent said second side of said wiring block, first wiring means for connecting each of said LED elements of said LED block to one of the selecting signal lines on said wiring block, and second wiring means for connecting said selecting signal lines to said data driver means, said data driver means causing the energization of selected ones of said plurality of LED elements by applying a signal to a selected LED through said second wiring means, said selecting signal lines and said first wiring means, said wiring block comprising a wiring substrate of a substance selected from the group consisting of glass and semiconductor materials, said wiring block being transparent, having a bottom and having a black film on said bottom.

9. An optical printing head comprising:

a head substrate, a plurality of elongated LED blocks each having a first side and a second opposing side and being arranged end to end along a scanning direction on said head substrate, each of said LED blocks having a plurality of LED elements arranged thereon which are to be selectively energized along said scanning direction, a plurality of elongated wiring blocks on said substrate each having a first side and an opposing second side, said wiring blocks each having said first side adjacent said second side of at least two of said plurality of LED blocks, said wiring blocks having a plurality of selecting signal lines, of a number at least equal to a number of said plurality of LED elements on each of said LED blocks to be selectively energized, formed thereon along the length of said wiring blocks and spanning the length of said plurality of LED blocks.

at least four data driver means on said substrate adjacent said second side of said wiring blocks each for selectively energizing each, of said LED elements of a number of said plurality of LED blocks, first wiring means for connecting a group of LED elements, formed by one of said LED elements of each of said plurality of LED blocks, to an identical selecting signal line on said wiring blocks, each of a number of said LED elements of each of said plurality of LED blocks being part of a separate group connected to the one selecting signal line, and second wiring means for connecting each of said selecting signal lines to said data driver means, said data driver means selectively causing the energization of the LED elements of each of said plurality of LED blocks through said second wiring means, a selecting signal line, and said first wiring means, wherein the LED elements are divided into a plurality of groups which are to be driven in time division, at least one of said groups including at least one of said LED elements of each of said LED blocks, said plurality of wiring blocks being arranged alongside and adjacent to said plurality of LED blocks, at least one of said wiring blocks having a length at least equal to the length of two LED blocks and said plurality of selecting signal lines of said at least one of said wiring block including (i) a plurality of bridging lines formed in parallel with each other on said one wiring block and having a length of substantially two LED blocks, and (ii) a plurality of selecting lead lines crossing said bridging lines and connected to a corresponding bridging line; and wherein said plurality of bridging lines are not electrically connected to each other between said plurality of wiring blocks, and at least two data driver means are provided for each of said wiring blocks.

* * * * *